United States Patent [19]

Ballard

[11] 4,242,817

[45] Jan. 6, 1981

[54] HOLDER

[76] Inventor: Donald M. Ballard, 7300 Leesburg Rd., Charlotte, N.C. 28215

[21] Appl. No.: 1,733

[22] Filed: Jan. 8, 1979

[51] Int. Cl.[3] ..... A47G 1/06; G09F 1/12

[52] U.S. Cl. ..... 40/152.1; 40/10 D

[58] Field of Search ..... 40/10 D, 152.1, 11 R; D6/235, 236, 238

[56] References Cited

U.S. PATENT DOCUMENTS

| | | | |
|---|---|---|---|
| 2,419,823 | 4/1947 | Cross et al. | 40/152.1 |
| 2,566,837 | 9/1951 | Huelsmeyer | 40/11 R |
| 3,914,888 | 10/1975 | Garrison | 40/10 R |
| 3,965,600 | 6/1976 | Paskerian | 40/152.1 |

FOREIGN PATENT DOCUMENTS

| | | | |
|---|---|---|---|
| 930437 | 1/1948 | France | 40/152.1 |
| 62417 | 6/1968 | German Democratic Rep. | 40/152.1 |

*Primary Examiner*—Gene Mancene
*Assistant Examiner*—Robert P. Swiatek
*Attorney, Agent, or Firm*—Bell, Seltzer, Park & Gibson

[57] ABSTRACT

A holder for pictures and the like formed by folding an integral sheet of transparent material to define a support portion, a face portion and a brace portion. The face and brace portions are joined to the support portion at spaced first and second fold lines and the three portions extend one relative to another in predetermined relationships for including acute angles therebetween. The brace portion has an end portion which terminates adjacent the face portion at a location intermediate the length of the face portion and the portions cooperate for retaining a picture and the like.

2 Claims, 5 Drawing Figures

HOLDER

FIELD AND BACKGROUND OF THE INVENTION

A variety of holders, stands, frames and the like have heretofore been proposed for use with pictures, photographs, show cards and similar objects. While such holders are widely used, many such holders are relatively complex by being formed of a relatively great number of parts and are, as a result, relatively expensive. Additionally, insertion of a picture and the like into holders of the type most usually seen is rendered somewhat difficult by a necessity to completely or substantially disassemble the holder before inserting the material to be displayed.

BRIEF DESCRIPTION OF THE INVENTION

It is an object of the present invention to provide a holder for pictures and the like which is relatively uncomplicated and, accordingly, is relatively simple to manufacture. In realizing this object of the present invention, a single integral sheet of an appropriate material is folded to define portions of a holder which cooperate in displaying a picture, photograph, show card and the like.

Yet a further object of the present invention is to facilitate ready insertion and removal of a picture and the like to be displayed in a holder. In realizing this object of the present invention, the integral sheet of material folded into the holder in accordance with the present invention has such resilience as to exert between portions of the holder a force effective for gripping engagement with a backing means and with a picture or the like inserted therebetween.

BRIEF DESCRIPTION OF THE DRAWING

Some of the objects of the invention having been stated, other objects will appear as the description proceeds, when taken in connection with the accompanying drawings, in which.

DETAILED DESCRIPTION OF INVENTION

While the present invention will be described hereinafter with particular reference to the accompanying drawings, it is to be understood at the outset of the detailed description that it is contemplated that the present invention may be modified from the specific form shown while still accomplishing the particular advantages of the present invention. Accordingly, the description which follows is to be understood as a broad teaching description directed to persons skilled in the applicable arts, and not as restrictive upon the scope of the present invention.

Figure 4:
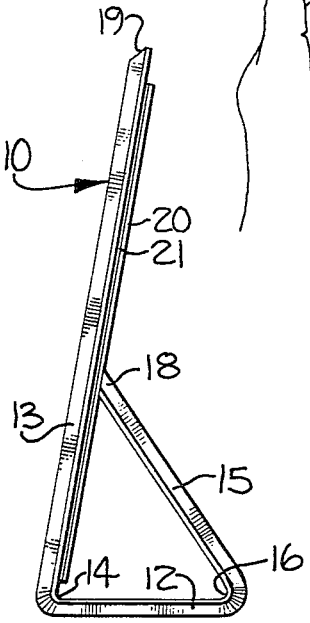
FIG. 4 is a side elevation view of the holder of FIGS. 1 through 3.
Figure 5:
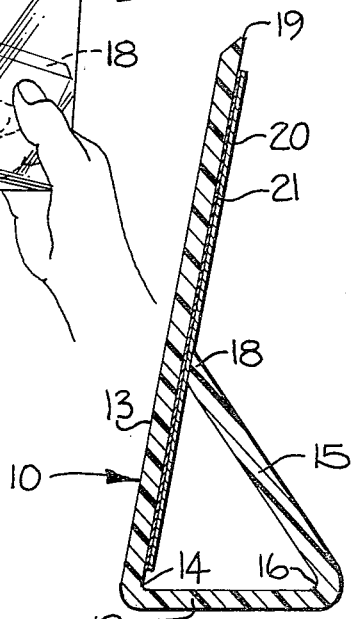
FIG. 5 is a section view through the holder of FIGS. 1 through 4, taken generally along the line 5—5 in FIG. 1.

Referring now more particularly to the drawing, a holder for pictures and the like is there shown which comprises an integral sheet generally indicated at 10 of transparent material folded to define a support portion 12, a face portion 13 joined to the support portion at a first fold line 14, and a brace portion 15 joined to the support portion 12 at a second fold line 16. The fold lines 14, 16 are parallel one to another and spaced apart at a predetermined distance as pointed out more fully hereinafter. The face portion 13 extends from the first fold line 14 for including an acute angle with the support portion 12 (FIGS. 4 and 5). The brace portion 15 extends from the second fold line 16 for including acute angles with the support portion 12 and with the face portion 13. In the form illustrated, the acute angle included between the face and support portions is approximately 80°, while the acute angle included between the support and brace portions is approximately 60° and the acute angle included between the brace and face portions is approximately 40°.

Preferably, the integral sheet 10 is of an appropriate thermoplastic material such as a suitable acrylic, polyolefin, polyester, polycarbonate, or polystyrene. A single, integral sheet of such material, formed as a substantially rectilinear solid of predetermined thickness, width, and length dimensions is used to form the holder of the present invention. As illustrated, such a sheet is provided with beveled edges. However, the edges may take other configurations as desired.

The sheet of material, as briefly indicated above, is folded into the holder in accordance with the present invention. In such folding, the first fold line 14 is disposed approximately midway of the length of the starting, integral sheet so that the front portion 13 comprises approximately one-half of the sheet. The second fold line 16 is spaced from the first fold line 14 at such a distance that the support portion comprises approximately one-sixth of the sheet, leaving approximately one-third of the sheet to form the brace portion 15. The end 18 of the brace portion 15 remote from the second fold line 16 terminates adjacent the face portion 13 at a location intermediate the first fold line 14 and an end portion 19 of the face portion which is remote from the first fold line. The brace portion at least closely approaches the face portion along a widthwise zone defined between its end portion 18 and the adjacent face portion 13. The widthwise zone is in the form of an area defined by an angled cross section through the sheet (FIGS. 2 through 5) providing for enhanced engagement with a picture or the like inserted into the holder. That widthwise zone preferably is located at a distance from the first fold line 14 of about one-half of the length dimension of the face portion from the first fold line 14 to the remote end portion 19. The material of the sheet 10 has such resilience so as to exert in that zone and between the face and brace portions a force effective for gripping engagement of the portions with a picture or the like inserted therebetween.

Figure 1:
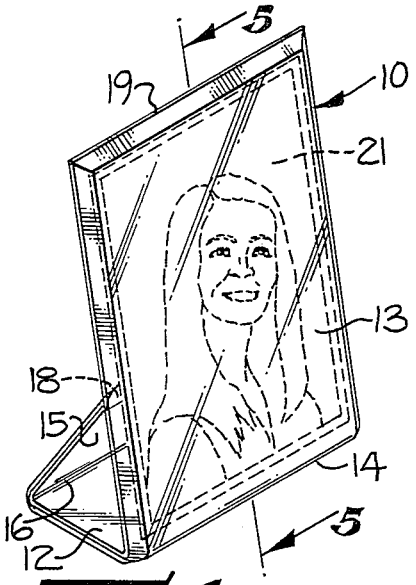
FIG. 1 is a perspective view from the front of the holder in accordance with the present invention.
Figure 2:
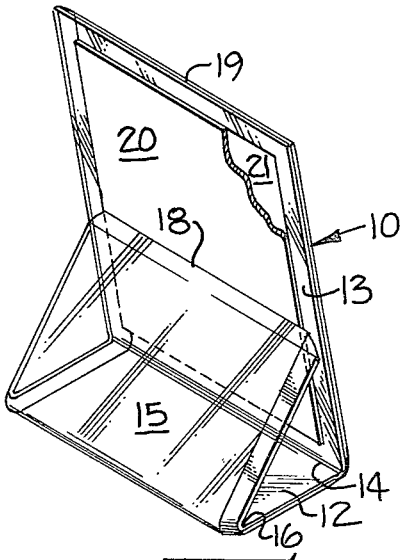
FIG. 2 is a perspective view from the rear of the holder of FIG. 1.
Figure 3:
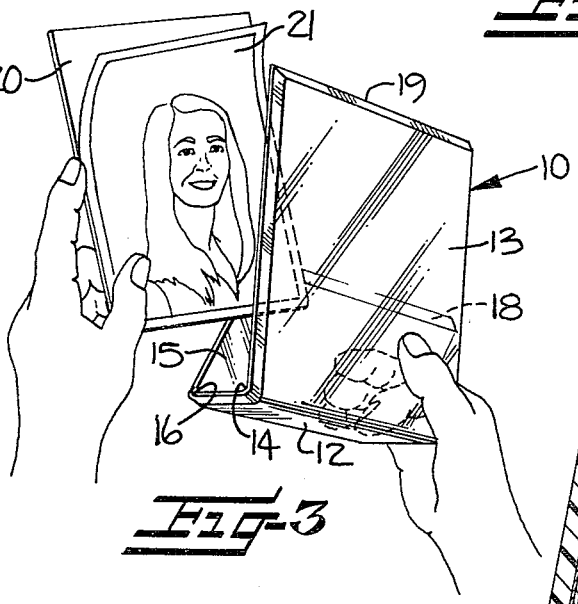
FIG. 3 is a perspective view of the holder of FIGS. 1 and 2, showing the insertion of a picture and backing thereinto.

More particularly, and as illustrated in FIG. 3, a backing means 20 preferably in the form of a relatively rigid card or sheet material is interposed between the face portion 13 and the end portion 18 of the brace portion 15 and cooperates in retaining a picture and the like, such as a photograph 21, in the holder of the present invention. Upon insertion of the backing means 20 and an item to be displayed such as the photograph 21, the acute angles included with the support portion 12 are opened or spread apart, thereby giving rise to a force effective for gripping engagement of the holder of the present invention with the backing means and a picture or the like inserted as illustrated in FIG. 3.

In the drawings and specification, there has been set forth a preferred embodiment of the invention, and although specific terms are employed, they are used in a generic and descriptive sense only and not for purposes of limitation.

That which is claimed is:

1. A holder for pictures and the like comprising an integral sheet of transparent material folded to define a linear support portion, a generally rectilinear face portion having predetermined width and length dimensions and joined to said support portion at a first fold line and extending therefrom at an acute angle of approximately 80° with said support portion, and a linear brace portion joined to said support portion at a second fold line parallel to and spaced from said first fold line, said brace portion forming an acute angle of approximately 60° with said support portion, said brace portion having an end portion remote from said second fold line and which terminates adjacent and in close proximity to said face portion at an area defined by an angled cross section through said sheet and spaced from said first fold line at a distance of about one half of said length dimension, said brace remote end portion and said face portion forming an acute angle of approximately 40°, and said material having such resilience as to exert in said area between said face portion and said end portion of said brace portion a force effective for gripping engagement with a picture or the like inserted therebetween.

2. A holder for pictures and the like comprising an integral sheet of transparent material having approximately one sixth thereof folded to defing a linear support portion, approximately one half of said sheet defining a generally rectilinear face portion having predetermined width and length dimensions and joined to said support portion at a first fold line and extending therefrom at an acute angle with said support portion, and the remainder of said sheet opposite said face portion defining a linear brace portion joined to said support portion at a second fold line parallel to and spaced from said first fold line and forming acute angles with said support and face portions, said brace portion having an end portion remote from said second fold line and which terminates adjacent and in close proximity to said face portion at an area defined by an angled cross section through said sheet and spaced from said first fold line at a distance of about one half of said length dimension, and said material having such resilience as to exert in said area between said face portion and said end portion of said brace portion a force effective for gripping engagement with a picture or the like inserted therebetween.

* * * * *